US006266981B1

(12) United States Patent
von Resch et al.

(10) Patent No.: US 6,266,981 B1
(45) Date of Patent: Jul. 31, 2001

(54) LOCK, IN PARTICULAR MORTISE LOCK FOR AN EXTERIOR DOOR

(75) Inventors: Julius von Resch, Stuttgart; Walter Renz, Ditzingen; Daniel Gründler, Leonberg; Udo Dieners, Besigheim/Ottmarsheim, all of (DE)

(73) Assignee: Gretsch-Unitas GmbH, Ditzingen (DE)

( * ) Notice: Subject to any disclaimer, the term of this patent is extended or adjusted under 35 U.S.C. 154(b) by 0 days.

(21) Appl. No.: 09/073,193

(22) Filed: May 6, 1998

(30) Foreign Application Priority Data

Nov. 5, 1997 (DE) ..... 297 19 611

(51) Int. Cl.[7] ..... E05B 59/00
(52) U.S. Cl. ..... 70/107; 70/110; 292/34
(58) Field of Search ..... 70/107, 108, 110, 70/111; 292/34, 36, 40, 336.3, 336.5, 165

(56) References Cited

U.S. PATENT DOCUMENTS 1,290,439 * 1/1919 Weller ..... 70/107
4,011,741 * 3/1977 Nolin ..... 70/107
4,578,967 * 4/1986 Yu ..... 70/107
4,606,203 * 8/1986 Esser ..... 70/107
4,870,841 * 10/1989 Cudd ..... 70/107
5,027,625 * 7/1991 Krachten ..... 70/107
5,301,525 * 4/1994 Doring ..... 70/107
5,813,255 * 9/1998 Tell, III et al. ..... 70/107
5,819,562 * 10/1998 Christ ..... 70/107
5,878,605 * 3/1999 Renz ..... 70/107

FOREIGN PATENT DOCUMENTS

8902020 * 3/1989 (WO) ..... 70/107

* cited by examiner

*Primary Examiner*—Suzanne Dino Barrett
(74) *Attorney, Agent, or Firm*—Jones, Tullar & Cooper, P.C.

(57) ABSTRACT

A lock for a door including a latch bolt and a further bolt mounted in a housing for parallel displacement relative to the housing. A bearing is fixed in place in the housing and along with a turning element and a two-armed hinged lever, also mounted to the housing operate on the latch bolt and the further bolt. The two arms of the two-armed hinged lever are pivotably connected with each other at their free ends with one of the arms receiving the fixed bearing between its ends, and with one of the arms being connected to the turning element and the other of its arms being connected to the further bolt.

21 Claims, 9 Drawing Sheets

LOCK, IN PARTICULAR MORTISE LOCK FOR AN EXTERIOR DOOR

FIELD OF THE INVENTION

The present invention relates to a lock, and in particular a mortise lock for an exterior door. The door has a latch bolt and a further bolt located displaceably parallel with each other in a housing, wherein the further bolt can be operated by means of a key and/or a turning knob, and the latch bolt can be selectively operated by means of a latch with a follower or by means of a key or by means of a turning knob.

BACKGROUND OF THE INVENTION

A lock for an exterior door is known from German Patent Publication DE 92 08 526 U1. This known lock has a latch bolt which can be retracted into the lock housing by means of a follower on which the latch is fastened. A further bolt is located underneath the latch bolt, which can be unlocked from the lock housing by means of a profiled cylinder. In addition, the profiled cylinder can be pulled into the latch bolt by means of a changer. Such a lock was developed for the German, or the European market.

American locks have the peculiarity that, as a rule, the latch with the follower and latch bolt are arranged at the bottom and the further bolt at the top in the lock housing. Furthermore, as a rule the further bolt is operated by means of a key on the one side and a turning knob on the other side. Such locks have properties which are comparable with the locks mentioned at the outset. However, it is not possible to couple connecting rods with such locks, by means of which supplemental lock boxes, or respectively supplemental bolts are attached, through which the resistance of the door to break-ins could be increased.

OBJECT AND SUMMARY OF THE INVENTION

It is therefore an object of the present invention to provide the lock mentioned at the outset that meets the requirements of the American market and can be used in the same way as American locks, and that furthermore as many components as possible can be taken over, or respectively only small changes need to be made.

This object is attained in accordance with the present invention in that the further bolt is connected via a two-armed hinged lever with a turning element actuated by the key or turning knob, that one arm of the hinged lever is pivotably coupled with the turning element and the other arm pivotably with the further bolt, and that the two arms are pivotably connected with each other with their free ends, wherein one arm is rotatably and, if required displaceably, seated between its ends on a bearing fixed in place in the housing.

By means of this embodiment in accordance with the present invention a lock, which is based on the features of a European mortise lock, is made available for the American market. It is therefore possible to use a mortise lock having a known lock housing, known, for example, from German Patent Publication DE 92 08 526 U1. This lock is merely turned over, so that the latch bolt is at the bottom and the further bolt at the top. In order to obtain a correct turning direction for turning the further bolt forward, i.e. for extending it, with this turned-over lock, a reversal of the direction of turning is created by means of a hinged lever. The key, or respectively the turning knob, drives a first hinge arm of the hinged lever, which is pivotably fastened on the rotating element and can be rotated around a shaft fixed in place in the housing. A reversal of the turning direction is created in this way, which is transferred by the other end of this pivot arm to a second pivot arm, which acts on the further bolt and extends it out of the lock housing. With the lock in accordance with the present invention, the further bolt is extended in that the turning element is turned either by the lock or by the turning knob in the conventional direction, i.e. in that the upper half of the key, or respectively of the turning knob is turned in the locking direction. Such a mortise lock can also be connected with a connecting rod.

Further advantages, characteristics and details of the present invention ensue from the following description, wherein several exemplary embodiments are described in detail, making reference to the drawings. The features represented in the drawings as well as in the specification can be essential to the present invention both individually per se and in any arbitrary combination.

DETAILED DESCRIPTION OF THE PREFERRED EMBODIMENTS

Figure 1:
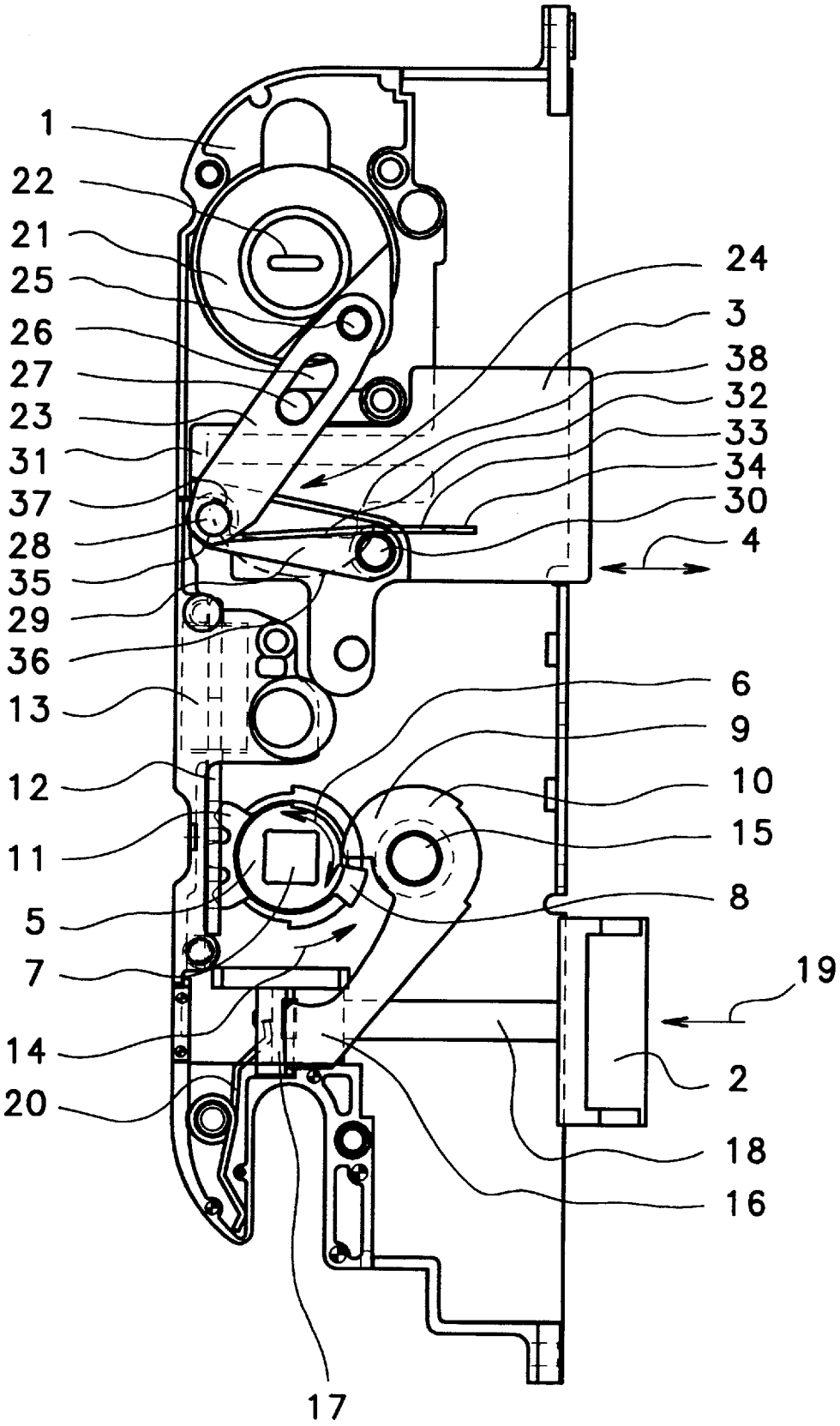
FIG. 1 is a top view of a first embodiment of a lock according to the present invention with the housing cover removed.

A lock housing, identified as a whole by 1 and with the cover removed, is shown in FIG. 1. A latch bolt 2 and a further bolt 3 in the interior of the housing can be displaced in the direction of the double-headed arrow 4. Furthermore, a follower 5 is seated, rotatable in the direction of the double-headed arrow 6, in the lock housing 1. The follower 5 has an opening 7, in particular a square opening, for receiving a square pin of a latch or similar actuating element. A radially extending shoulder 8 of the follower 5 is located underneath a protrusion 9 of a latch bolt arm 10, by means of which the latch can be turned back. Furthermore, the follower 5 has a partial gear ring 11, which engages a toothed rack 12, which is held in the standby position represented in FIG. 1 by means of a restoring spring, not shown, located in a spring housing 13. The toothed rack 12 can be displaced in both directions from this standby position. If therefore the follower 5 is turned in the direction of the arrow 14, this causes a compression of the restoring spring on the one hand and, on the other, the shoulder 8 comes to rest against the protrusion 9 of the latch bolt arm 10 and pivots the latter in a clockwise direction around a bearing 15. By means of this action an actuating arm 16 is displaced and engages a shoulder 17 of a latch bolt tail 18. This causes the latch bolt 2 to be turned back into the lock housing 1 in the direction of the arrow 19. The extension of the latch bolt 2 after the latch has been released and after the restoration of the follower 5 by means of the restoring spring, not shown, is aided by a torsion spring 20, which is supported on the one side on the lock housing 1, and acts on the shoulder 17 with the other leg and pushes the latch bolt 2 out of the lock housing 1. In this case the extension movement is approximately 10 mm.

Furthermore, a turning element 21 is rotatingly seated in the lock housing 1, wherein the turning element 21 is provided with a slit 22. A corresponding wedge of a turning knob engages this slit 22 on the one side, for example, and on the other side a corresponding wedge of a cylinder, which can be actuated by means of a key. In this case the turning element 21 is designed in such a way that it can be installed in already existing recesses, into which a profile cylinder can be inserted. A first arm 23 of a hinged lever 24 is fastened, pivotable around a bolt 25, on the turning element 21. The first arm 23 furthermore has an elongated hole 26, which is engaged by a pin 27 fixed in place on the housing. On the side opposite the bolt 25, the first arm 23 is pivotably connected via a pivot bearing 28 with a second arm 29, wherein the second arm 29 acts on a bolt tail 31 of the further bolt 3 by means of a bolt 30. A torsion spring 32 is seated around the bolt 30 and is supported by means of its leg 33 in a receptacle 34 of the further bolt 3, while with its other leg 35 it extends around the pivot bearing 28. The torsion spring 32 is laid out in such a way that the pivot bearing 28 is urged around the bolt 30 in a clockwise direction.

The lock in accordance with a first exemplary embodiment represented in FIG. 1 has the important advantage that, in the manner of American locks, it has a latch bolt 2 on the bottom and a further bolt 3 at the top, wherein the further bolt 3 can be moved forward out of the key housing by actuating the turning element 21 by means of a key or by means of a turning knob in a clockwise direction (in the position represented). In this case the extension is approximately 25 mm.

The forward displacement of the further bolt 3 by rotating the turning element 21 in a clockwise direction takes place in that in the course of rotation of the turning element 21, the first arm 23 is taken along by the bolt 25 and turned in a counterclockwise direction around the pin 27, and in addition is displaced in the direction toward the elongated hole 26. This causes the second arm 29 to be displaced essentially in the extension direction of the further bolt 3 (toward the right). In addition, the bolt or pivot bearing 28 performs an arc-shaped movement suggested by the dashed line 36. On its side facing away from the viewer, the pivot bearing 28 has an axial protrusion which, in the position of the hinged lever 24 represented in FIG. 1, extends behind a shoulder 37 fixed in place on the housing. In this way displacement of the further bolt 3 out of the lock housing 1 is prevented without actuation of the turning element 21. In the end position of the pivot bearing 28 with the further bolt 3 extended, not shown in FIG. 1, the axial protrusion of the pivot bearing 28 is located behind a second shoulder 38 fixed in place on the housing, by means of which it is accomplished that the extended further bolt 3 cannot be pushed back into the lock housing 1 without rotating the turning element 21.

Figure 2:
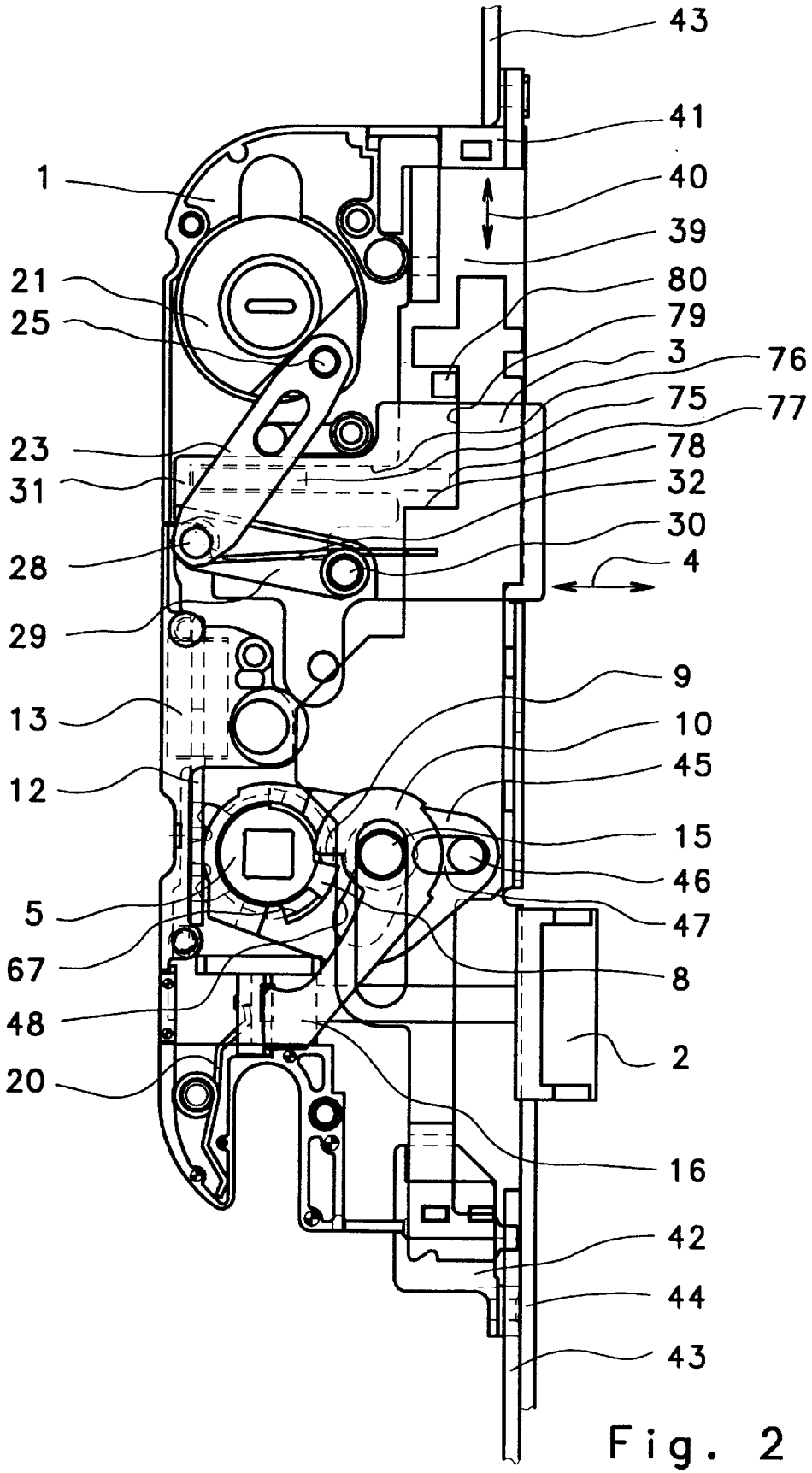
FIG. 2 is a top view of a second embodiment of a lock according to the present invention with the housing cover removed.

FIG. 2 represents a second exemplary embodiment of the lock in accordance with the present invention, wherein like components are identified with the same reference numerals. In this exemplary embodiment a connecting rod plate 39 is seated in the lock housing 1 and is moveable in the direction of the two-headed arrow 40. Connecting rods 43 are connected at 41 and 42 to this connecting rod plate 39. These connecting rods 43 are located behind cover rails 44 which, in the installed position of the lock 1, finish and cover it on the visible side.

In FIG. 2, a turning slider 45 is rotatably fastened to the follower 5. If the follower 5 is activated, the turning slider 45 is taken along, which will be explained further below. The turning slider 45 has a bolt 46, which engages an elongated hole 47 in the connecting rod plate 39. The turning slider 45 furthermore has a curved elongated hole 48, by means of which the bearing 15 is bypassed.

Thus, if the follower 5 is moved counterclockwise, for example, the protrusion 9 of the latch bolt arm 10 is taken along by the shoulder 8 and is moved around the bearing 15 in a clockwise direction, as a result of which the latch bolt 2 is pushed into the lock housing 1. Furthermore, the turning slider 45 is pivoted by the rotating movement of the follower 4 and the bolt 46 is displaced upwardly, as a result of which the connecting rod plate 39 is also displaced upwardly. In this way, the connecting rods 43 are pushed upwards.

Figure 3:
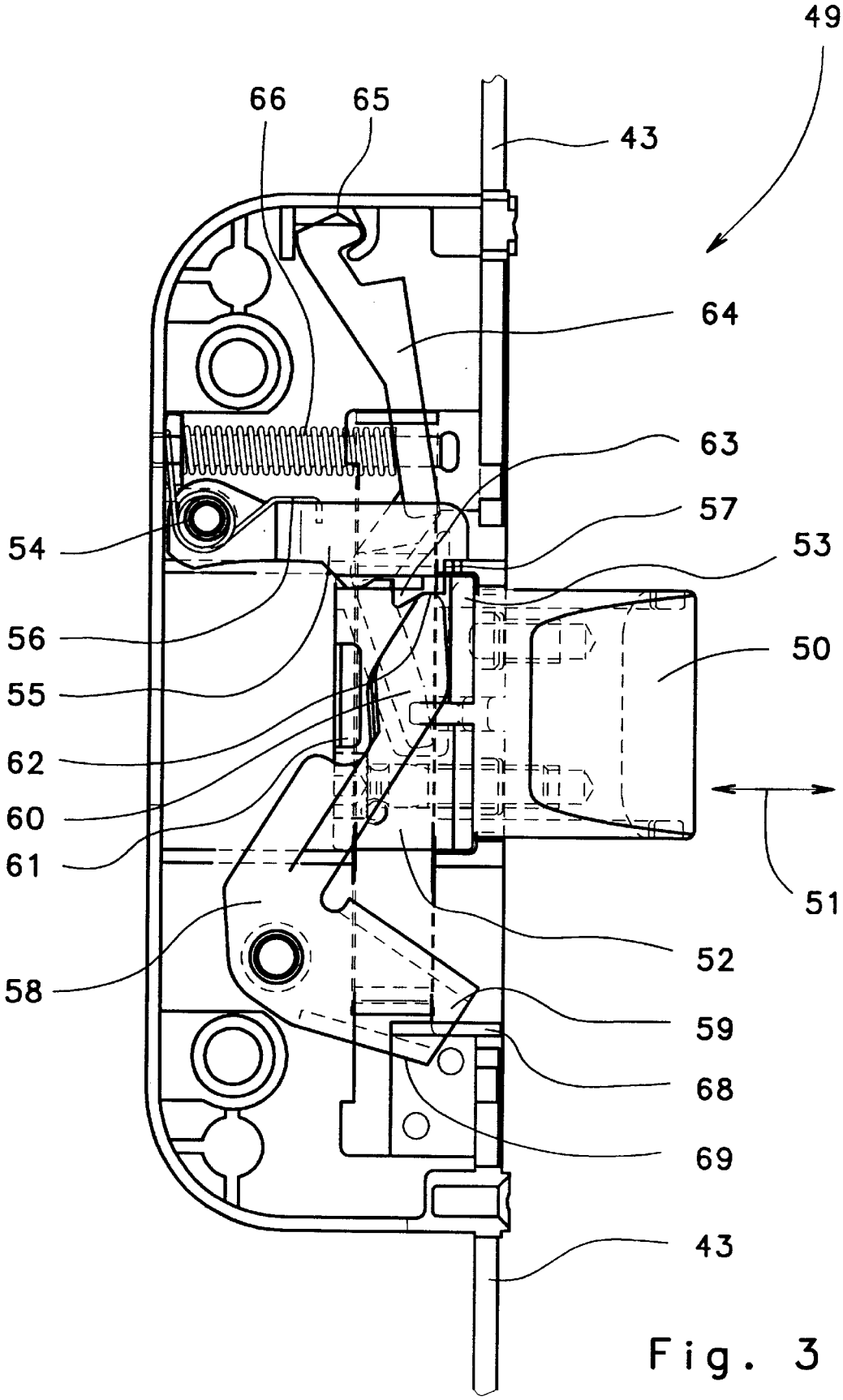
FIG. 3 is a top view of an enlarged representation of a supplemental bolt lock with the housing cover removed.

A supplemental lock 49 is represented in FIG. 3, wherein the cover has also been removed. This supplemental lock 49 is connected with the lock housing 1 of the mortise lock by means of the connecting rod 43. A latch bolt 50 is seated, displaceable in the direction of the two-headed arrow 51, in the supplemental lock 49. In the representation shown, this latch bolt 50 is in its turned-forward position. The latch bolt 50 has a latch bolt tail 52 including a protrusion 53.

It is furthermore possible to see in FIG. 3, that a latch bolt detent lever 55 is pivotably seated around a bearing bolt 54, and is spring-loaded in a clockwise direction by means of a detent lever spring 56 embodied as a torsion spring. If the latch bolt 50 is in the completely extended position, i.e. in the locking position, a latch detent edge 57 extends around the protrusion 53. Although a short gap can exist between the protrusion 53 and the latch detent edge 57, as represented in FIG. 3, the latch detent edge 57 extends into the displacement track of the protrusion 53, so that the latch bolt 50 cannot easily be inserted into the housing of the supplemental lock 49. Thus, in its locked position the latch bolt 50 is locked against unauthorized insertion.

If a latch restoration lever 58, which rests with its one arm 59 against the free end of the connecting rod 43, and with its other arm 60 against a further protrusion 61 of the latch bolt tail 52, is pivoted via the connecting rod 43, a protrusion 62 of the free arm 60 engages a crank 63 of the latch bolt detent lever 55 and lifts it sufficiently out of its locked position in which the latch detent edge 57 extends behind the protrusion 53, so that the latch detent edge 57 moves out of the displacement track of the protrusion 53. The arm 60 furthermore rests against the protrusion 61 and, in the course of the pivoting of the latch restoration lever 58, it pulls the latch bolt 50 into the supplemental lock 49. The extension of the latch bolt 50 takes place by means of a latch extension lever 64, which is seated at the bearing 65 and is driven in a counterclockwise direction around the bearing 65 by a latch extension spring 66. With its free end, the latch extension lever 64 acts on the latch bolt 50 and attempts to move it out of the supplemental lock 49.

Now, if the follower 5 (FIG. 2) is moved into the locking position (turned in a clockwise direction), the latch bolt 50 of the supplemental lock 49 is turned forward. Since the shoulder 8, by means of which the turning slider 45 is taken along, moves in a curved cutout 67, the turning slider 45, and therefore also the connecting rod plate 39, remains in the deflected position when the follower 5 is restored into the initial position, represented in FIG. 2, by means of the restoring spring. The latch bolt 50 therefore remains extended.

If the follower 5 is moved in a counterclockwise direction by pushing down the latch, the latch bolt arm 10, for one, and the turning slider 45, for another, are moved via the shoulder 8, as represented in FIG. 2, and thereby the latch bolt 2 is turned back and the connecting rod plate 39 is pushed into its initial position, as a result of which the arm 59 of the latch restoration lever 58 is moved via the coupled connecting rod 43 in that a slider 68 acts on a protrusion 69 of the arm 59 and pivots it in a counterclockwise direction. In the process and as described above, following the unlocking of the latch bolt 50 the arm 60 pulls the latch bolt 50 back over the protrusion 61 into the housing of the supplemental lock 49.

Figure 4:
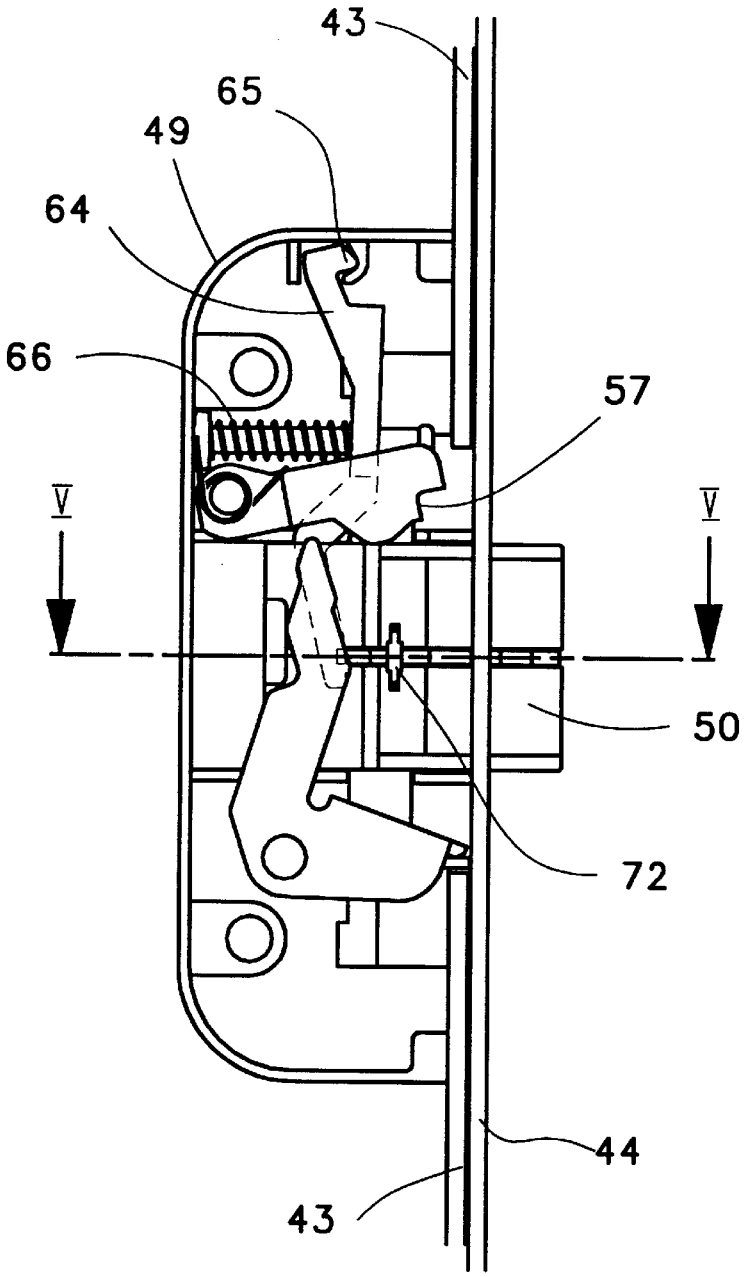
FIG. 4 is a top view of a further embodiment of a supplemental bolt lock with the housing cover removed.

A second exemplary embodiment of the supplemental lock 49 is represented in FIG. 4. With this supplemental lock 49 the latch bolt 50 is automatically pushed out of the lock housing when the door is closed. To this end the latch bolt 50 is provided with a groove 70, extending in its longitudinal direction and open at one side. A detent element 71 is located in this groove 70, which is seated, pivotable around a clamping sleeve 72, in the groove 70 and therefore in the latch bolt 50. This detent element 71 is provided with a detent protrusion 73 as well as with a triggering protrusion 74.

Figure 5:
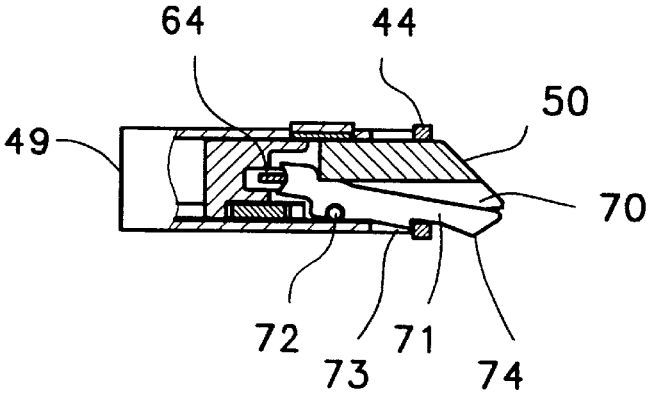
FIG. 5 shows a section V—V through the supplemental bolt lock in accordance with FIG. 4.

In the latch position represented in FIG. 5, the detent protrusion 73 extends behind the cover rail 44 and prevents further extension of the latch bolt 50, which is spring-loaded. This spring force, as already mentioned above, is provided by the latch extension spring 66 (FIG. 4), which has been pushed onto a guide pin and is supported on the one side on the inner wall of the housing of the supplemental lock 49 and on the other side on the latch extension lever 64. This latch extension lever 64 is pivotably seated in the bearing 65. The end of the latch extension lever 64 opposite the bearing 65 acts on the end of the detent element 71 located opposite the trigger protrusion 74 and urges it in the extension direction under the force of the latch extension spring 66. Since the detention element 71 is connected via the clamping sleeve 72 with the latch bolt 50, the latter is also urged in the extension direction. It can be seen in FIG. 5 that, although the latch extension lever 64 acts on the detent element 71, the direction of the force of the latch extension lever 64 does not pass through the pivot bearing of the detent element constituted by the clamping sleeve 71, so that the latch extension lever 64 exerts a pivot moment in the clockwise direction on the detent element 71. The detent protrusion 73 as well as the triggering protrusion 74 are pivoted out of the groove 70 by means of this pivot moment.

With the door open (not shown), the latch bolt 50 is therefore in the latch position represented in FIGS. 4 and 5, in which a further extension is prevented because the detent protrusion 73 extends behind the cover rail 44.

In the course of closing or pushing the door closed, the latch bolt 50 is inserted into the supplemental lock 49 over the locking plate attached to the door frame, not shown. If the door is in its closed position and the latch bolt 50 is aligned with a latch opening in the locking plate on the side of the door frame, the fully inserted latch bolt 50 is pushed out of the supplemental lock 49 by means of the latch extension lever 64. In the course of this extension movement, the locking element 71 is simultaneously pivoted in a clockwise direction around the clamping sleeve 72. In the process, the trigger protrusion 74 comes into contact with the edge of the latch opening of the locking plate facing it, as a result of which the detent element 71 is pushed against the pivot moment sufficiently far into the groove 70, so that the detent protrusion 73 can slide past the cover rail 44. An arrestment of the latch bolt 50 in the latch position in accordance with FIG. 5 is prevented in this way, so that the latch bolt 50 can be extended into the locking position. In this locking position the latch bolt 50 has been extended approximately 10 mm 15 mm farther out of the supplemental lock 49 than in the latch position in accordance with FIG. 5.

There is a suggestion in FIG. 2, that the latch tail 31 be provided with a detent extension 75 on its underside, which projects downwardly and is seated, displaceable in the direction of the two-headed arrow 4, in a receiving groove 76 fixed in place on the housing. The further bolt 3 is guided by this detent extension 75. Furthermore, when turning the further bolt 3 forward (not shown), the detent extension 75 is pushed out of the receiving groove in the extension direction sufficiently far, so that it extends behind a shoulder 78 of the connecting rod plate 39, as represented by the dash-dotted line 77. With the further bolt 3 turned forward, the connecting rod plate 39 is essentially fixed in place in this manner in the position represented in FIG. 2. With its cutout 79, the connecting rod plate 39 can only be displaced between the detent extension 75 (77) and a guide block 80, which is fixed in place on the housing. However, the connecting rod plate 39 can no longer be displaced backward, i.e. upward. When the further bolt 3 has been extended by means of a key, opening of the lock can no longer be accomplished by actuating the follower 5.

Figure 6:
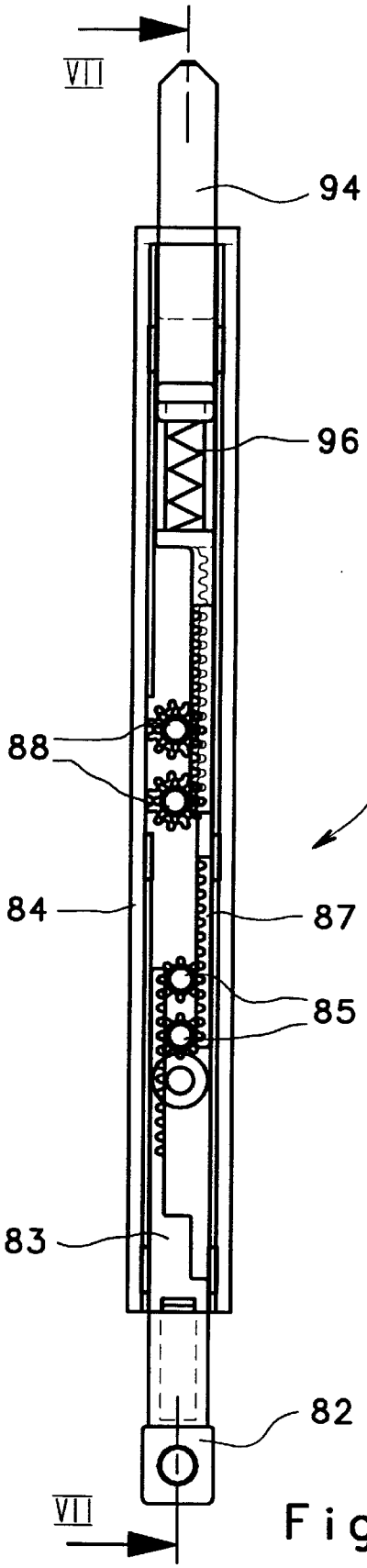
FIG. 6 is a longitudinal section through a connecting rod extender with a gear.
Figure 7:
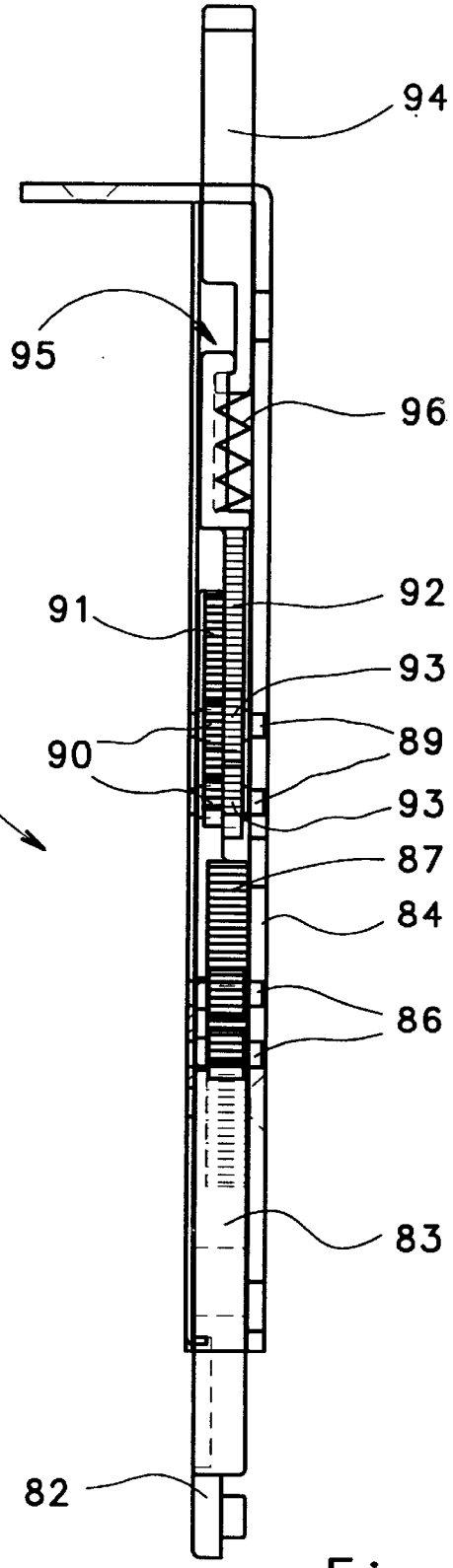
FIG. 7 is a section taken along lines VII—VII through the connecting rod extender in accordance with FIG. 6.

A rack extension 81 is represented in FIGS. 6 and 7, which is coupled by means of a coupling 82 with a connecting rod 43, not shown. This coupling 82 is located on a first toothed rack 83, which terminates in the housing 84 of the rack extension 81. The first toothed rack 83 drives two gear wheels 85 seated in journals 86 fixed in place on the housing. A second toothed rack 87 is driven by means of these gear wheels 85, which now moves opposite with respect to the first toothed rack 83. Thus, a reversal of direction is provided by means of these gear wheels 85. The second toothed rack 87 transmits the movement to two pairs of gear wheels 88 seated on journals 89. The smaller gear wheels 90 of these pairs of gear wheels 88 are driven by means of the second toothed rack 87. To this end the toothed rack 87 is provided with a toothed rack element 91 which is embodied to be considerably more narrow than the toothed rack 87, but has a greater thickness, which can be seen in FIG. 6. A third toothed rack 92 located laterally next to the toothed rack element 91, is of lesser thickness and meshes with the larger gear wheel 93 of the pair of gear wheels 88. Together with the gear wheel pair 88, the toothed rack element 91 and the third toothed rack 92 constitute a transmission gear, so that the displacement movement of the connecting rod 43 generates an extension of the detent pin 94 of approximately 25 mm. This detent pin 94 is connected via a hook connection 95 with the third toothed rack 92, wherein the lower end of the detent pin 94 is loaded in the extension direction by means of a compression spring 96. It is possible in this way to uncouple the detent pin 94 from the further extending third toothed rack 92 at the completion of extension, so that damage to the transmission gear, or respectively the rack extension 81 are prevented in general.

Figure 8:
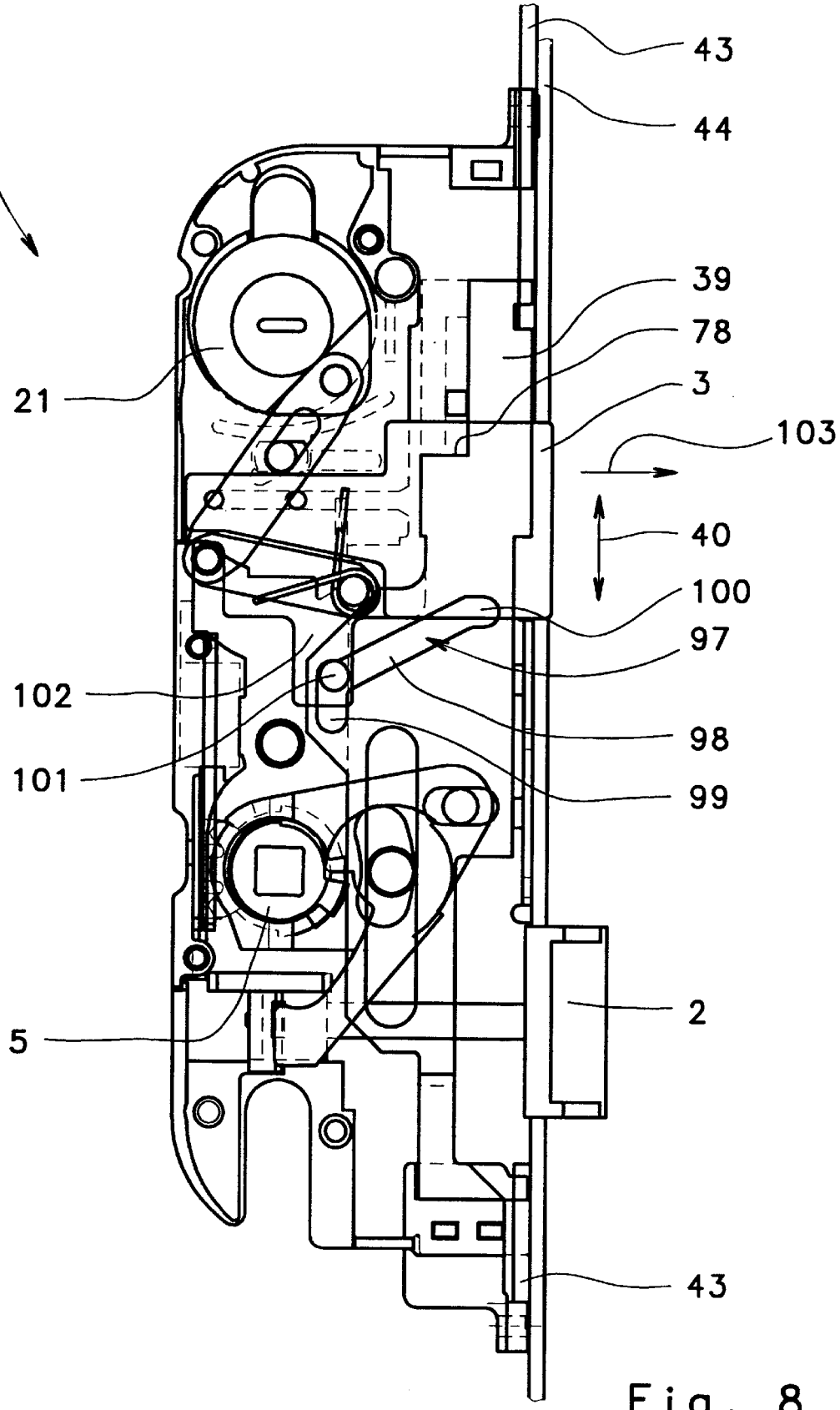
FIG. 8 is a top view of a third embodiment of a lock according to present invention with the housing cover removed.

The exemplary embodiment represented in FIG. 8 shows a further variant of the mortise lock in accordance with the present invention, wherein the connecting rod plate 39 is provided with a crank 97. A guide pin 101, which projects from a bolt extension 102, acts on this crank 97, which is being constituted by an obliquely extending section 98 and a section 99 extending in the direction of the two-headed arrow 40, as well as an end section 100 orthogonally with respect to it. If the further bolt 3 is actuated by means of the turning element 21, i.e. by means of a key or the turning knob, which has been described further above, the guide pin 101 is moved in the crank 97. In the course of turning the further bolt 3 forward, the guide pin 101 is displaced in the direction of the arrow 103. This leads to a movement of the guide pin 101 in the oblique section 98, as a result of which connecting rod plate 39 is displaced downwardly until the guide pin 101 comes to lie in the end section 100. It is possible in this way to actuate the connecting rod 43 by moving the further bolt 3 forward, actuated by a key or the turning knob. Furthermore, in the extended position of the further bolt 3, the connecting rod plate 39 is blocked in that, as described in connection with FIG. 2, the detent extension 75 represented there extends behind the shoulder 78 of the connecting rod plate 39.

Figure 9:
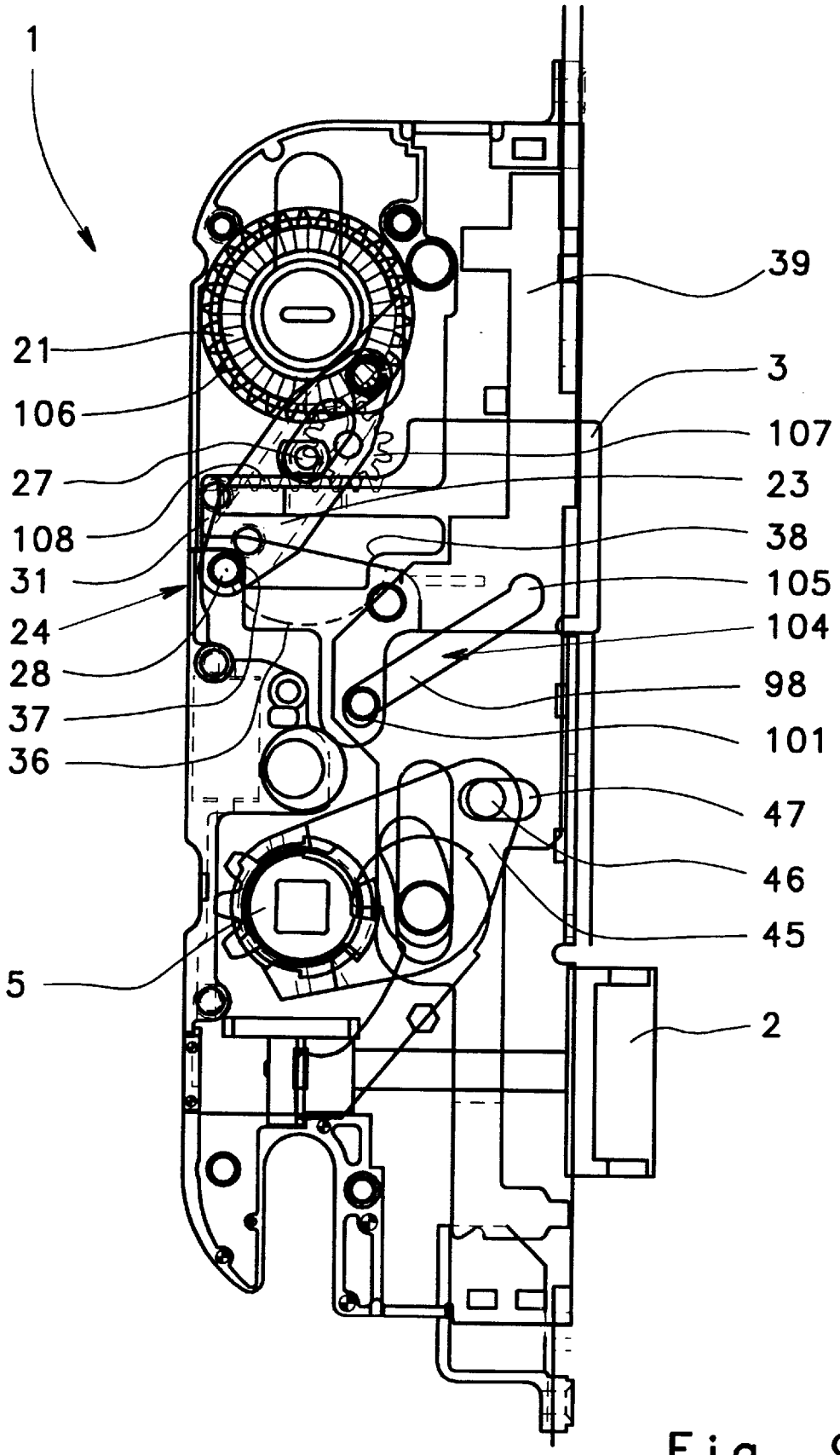
FIG. 9 is a top view of a fourth embodiment of a lock according to the present invention with the housing cover removed.

A further variant of the lock in accordance with the present invention is represented in FIG. 9, wherein the forward movement of the further bolt 3 takes place by actuation of the follower 5 in a clockwise direction. Such a lock is also called a "fast lock". With this lock the connecting rod plate 39 also has a crank 104, which has an oblique section 98, but has an end section 105 extending in the direction of movement of the connecting rod plate 39. The guide pin 101 is guided in this crank 104. If now the follower 5 is turned in a clockwise direction, the bolt 46, which engages an elongated hole 47 of the connecting rod plate 39, is moved downward via the turning slider 45. This causes the guide pin 101 to be displaced in the extension direction of the further bolt 3 in the oblique section 98, which is also moved downward, as a result of which the further bolt 3 is moved forward. In the process, a toothed rack 108 of the bolt tail 31 meshes with a pinion 107, which in turn meshes with a crown gear 106 of the turning element 21. The turning element 21 is rotated in this way past the bolt extension, as a result of which the arm 23 of the hinged lever 24 is rotated in a counterclockwise direction around the journal 27, so that the pivot bearing travels the curved track 36 described in FIG. 1 and therefore the axial protrusion moves around the shoulder 37 fixed in place on the housing and comes to lie behind the shoulder 38. The further bolt 3 is secured against unauthorized retraction by this shoulder 38.

However, this bolt extension can also take place in that the turning element 21 is rotated, so that the crown gear 106 meshes with the toothed rack 108 of the bolt tail 31 and the bolt 3 is moved forward in this way. However, with the further bolt 3 extended, the toothed rack 108, which is made appropriately short, comes out of engagement with the pinion 107 in every case. If an attempt is now made to displace the connecting rod plate 39 upward, i.e. in the opening direction, by turning the follower 5 in a counterclockwise direction, this movement is blocked by the shoulder 38, fixed in place on the housing, with which the axial protrusion of the pivot bearing 28 comes into contact. The bolt can therefore not be pushed back past the latch, or respectively the follower 5. Therefore unlocking can only exclusively be performed via the turning element 21, i.e. by means of a key or by means of the turning knob. To this end the turning element 21 is provided with a ratchet constituted by two disks equipped with saw teeth on the sides facing each other. These saw teeth are arranged in such a way that they are permanently in engagement in one direction and, in the other direction of rotation, become disengaged starting at a defined torque.

Locking of the further bolt 3 by means of the shoulder 38 fixed in place on the housing is cancelled in that the turning element 21 is rotated counterclockwise in the opening direction. Since the pinion 107 is out of engagement with the toothed rack 108, the latter, and therefore the further bolt 3, are not taken along. Although the arm 23 of the hinged lever 24 is pivoted, the released pivot bearing 28 opens and becomes disengaged from the arm 29. In FIG. 9 the arm 29 has not been drawn in for the sake of clarity. Since the pivot bearing 28 moves on the curved track 36, the axial protrusion comes free of the shoulder 38 and is displaced behind the shoulder 37. The further bolt 3 remains extended, but is no longer secured. It is now possible to displace the connecting rod plate 39 upward by pushing the latch down and to pull back the further bolt 3 via the crank 104. In the process the 1s toothed rack 108 again comes into engagement with the pinion 107 and drives it and therefore also the crown gear 106. Since the turning element 21 is already in its end position assigned to the open position, the ratchet is actuated, so that no damage of the turning element 21 occurs.

Figure 10:
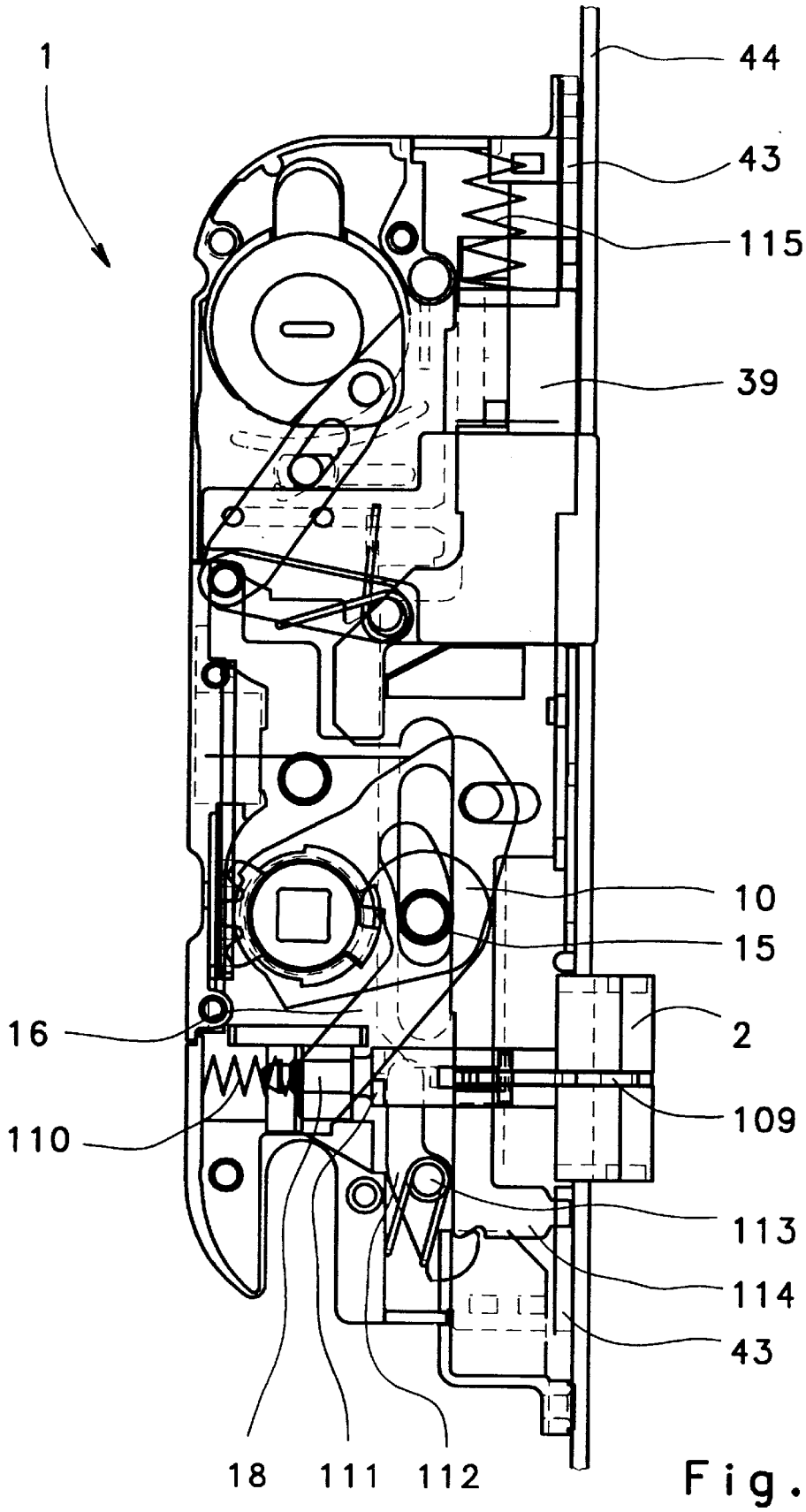
FIG. 10 is a top view of a fifth embodiment of a lock according to the present invention with the housing cover removed.

A further exemplary embodiment of the lock in accordance with the present invention is represented in FIG. 10, wherein the latch bolt 2 has the structure corresponding to the latch bolt 50 represented in FIGS. 4 and 5. If a door with such a lock 1 is closed, the blocking of the blocking element 109 is automatically cancelled and the latch bolt 2 is moved forward by the force of a compression spring 110 acting on the latch bolt tail 18. In the process, the actuating arm 16 of the latch bolt arm 10 is pivoted counterclockwise around the bearing 15. The latch bolt tail 18 furthermore has a protrusion 111, which acts on a blocking lever 112, which can be pivoted around a bolt 113 fixed in place on the housing. This blocking lever 112 extends behind the free end 114 of the connecting rod plate 39 and blocks it against a downward displacement, in which direction the connecting rod plate 39 is loaded by a compression spring 115. If, however, the blocking lever 112 is pivoted in a clockwise direction around the bolt 113 past the protrusion 111, the engagement behind the free end is cancelled and the connecting rod plate 39 can be displaced downwardly.

Figure 11:
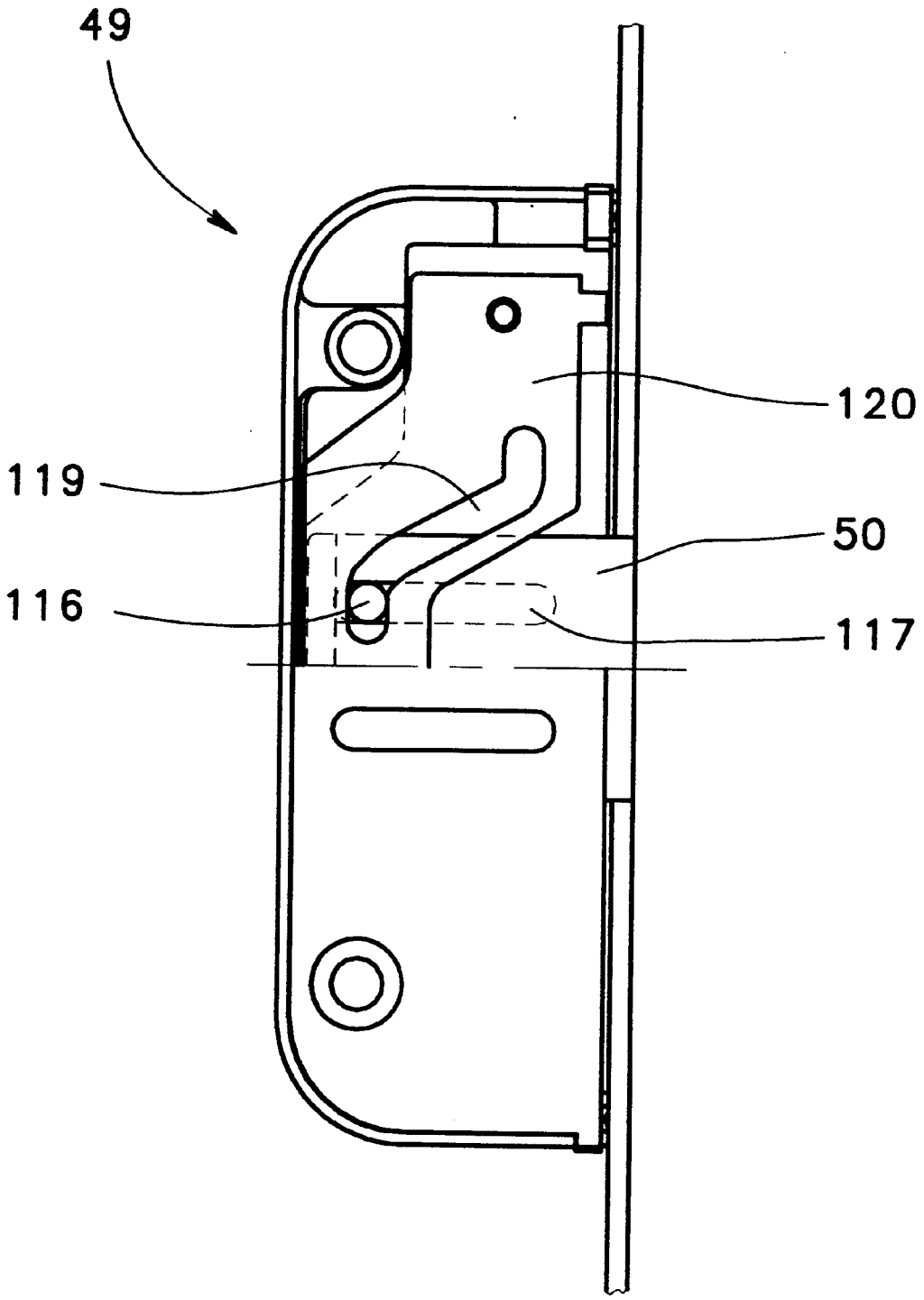
FIG. 11 is a top view of a further supplemental bolt lock according to the present invention, partially in section.

With the fully automatic extension of the latch bolt 2, the latch bolts 50 coupled with the connecting rod 43 are also extended. A simple latch bolt 50 of this type is represented, for example, in the supplemental lock 49 in FIG. 11, wherein the latch bolt 50 is guided via a guide pin 116 in an elongated hole 117 of the housing cover 118 as well as in the crank 119 of a drive plate 120. This drive plate 120 is coupled with the connecting rod 43.

The lock in accordance with the present invention has the essential advantage of having a multitude of conventional components, but can still be used in the US market.

What is claimed is:

1. A lock for a door, comprising:

a housing including an opening;

a latch bolt and a further bolt both mounted to said housing for parallel displacement relative to said housing, said further bolt being operated for said parallel displacement by one of a key, a turning knob, and a key and turning knob, and said latch bolt being selectively operated by one of a latch with a follower, a key, and the turning knob;

a turning element mounted to said housing, said turning element being actuated by a key or a turning knob;

a two-armed hinged lever pivotably connected to said turning element with one arm of said two-armed hinged lever and pivotably coupled to said further bolt with the other arm of said two-armed hinged lever; and a bearing fixed in place in said housing;

wherein the two arms of said two-armed hinged lever each have a free end and are pivotably connected with each other at their free ends, with one arm of said two-armed hinged lever receiving said bearing between the ends thereof.

2. The lock as defined in claim 1, further comprising:

a bolt for connecting said two arms of said two-armed hinged lever at their free ends, said bolt having an axial protrusion relative to said housing.

3. The lock as defined in claim 2, wherein said bolt traverses a curved path when said turning element and said two-armed hinged lever are actuated.

4. The lock as defined in claim 3, wherein said curved path defines an end position, and wherein said bolt is at said end position of said curved path when said further bolt is extended.

5. The lock as defined in claim 4, further comprising:

a first shoulder fixed in place in said housing, said first shoulder being located behind said bolt when said bolt is at said end position associated with the retracted direction of said further bolt.

6. The lock as defined in claim 3, further comprising:

a second shoulder fixed in place in said housing, said second shoulder being located behind said bolt when said bolt is at said end position associated with the extended direction of said further bolt.

7. The lock as defined in claim 2, wherein said bolt is spring loaded in the direction of said free ends of said two-armed hinged lever.

8. The lock as defined in claim 1, further comprising:

a connecting rod plate, from which connecting rods are suspended; and a follower for actuating said connecting rod plate.

9. The lock as defined in claim 8, wherein said further bolt has a detent extension which blocks said connecting rod plate in an end position when said further bolt is extended.

10. The lock as defined in claim 8, further comprising:

a supplemental bolt lock connected by means of at least one of said connecting rods, wherein said latch bolt can be extended or retracted by means of said connecting rods actuated by said connecting rod plate.

11. The lock as defined in claim 10, further comprising:

a spring for spring-loading said latch bolt, wherein said latch bolt is spring-loaded in its extended direction, and wherein said latch bolt has a detent element which maintains said latch bolt in a partially retracted position when the door of said lock is open, and is triggered when the door is closed, so that said latch bolt automatically changes into the extended position under the force of said spring.

12. The lock as defined in claim 8, wherein said at least one connecting rod is provided with a gear, in the form of one of a transmission gear, a reversing gear, and a transmission gear and reversing gear.

13. The lock as defined in claim 12, further comprising:

a rack extension, extendible in the axial direction of said at least one connecting rod, wherein said gear is coupled with said rack extension.

14. The lock as defined in claim 8, wherein said connecting rod plate is coupled with said further bolt.

15. The lock as defined in claim 14, wherein said connecting rod plate includes a crank, and wherein said further bolt includes a guide pin which engages said crank.

16. The lock as defined in claim 15, wherein on its one end, at which said guide pin is located when said further bolt is extended, said crank includes a section which extends in the displacement direction of said connecting rod plate.

17. The lock as defined in claim 1, further comprising:

a pinion; and a toothed rack formed on the tail of said further bolt, wherein said turning element includes a crown gear on its circumferential surface, and wherein said crown gear meshes via said pinion with said toothed rack.

18. The lock as defined in claim 8, wherein said latch bolt is spring-loaded in the extension direction, said latch bolt including a blocking element which, when the door of said housing is open, maintains said latch bolt in the retracted position and which is triggered when the door is closed, so that said latch bolt automatically changes into its extended position by the force of its spring load.

19. The lock as defined in claim 17, further comprising:

a compression spring; and a blocking lever which extends behind and locks said connecting rod plate in its end position assigned to unlocking, wherein the force of said compression spring acts on said connecting rod plate in the direction toward the position assigned to locking.

20. The lock as defined in claim 2, wherein said bolt serves as a releasable pivot bearing, and wherein the two arms of said two-armed hinged lever are connected to each other by said releasable pivot bearing.

21. The lock as defined in claim 20, wherein said releasable pivot bearing is released in one direction, including the unlocking direction.

* * * * *